US008623150B2

(12) United States Patent
Vroom et al.

(10) Patent No.: US 8,623,150 B2
(45) Date of Patent: Jan. 7, 2014

(54) BATCH DISHWARE WASHING MACHINE WITH STEAM VENTING

(75) Inventors: Robert C. Vroom, Kernersville, NC (US); Patrick S. Conklin, Kernersville, NC (US)

(73) Assignee: Champion Industries, Inc., Winston-Salem, NC (US)

( * ) Notice: Subject to any disclaimer, the term of this patent is extended or adjusted under 35 U.S.C. 154(b) by 54 days.

(21) Appl. No.: 13/332,692

(22) Filed: Dec. 21, 2011

(65) Prior Publication Data

US 2013/0160801 A1 Jun. 27, 2013

(51) Int. Cl.

| | |
|---|---|
| ***B08B 9/20*** | (2006.01) |
| ***A47L 15/00*** | (2006.01) |
| *A47L 15/48* | (2006.01) |
| *B08B 9/28* | (2006.01) |

(52) U.S. Cl.

CPC ..... *A47L 15/0081* (2013.01)
USPC ..... 134/25.2; 134/56 D; 134/58 D

(58) Field of Classification Search

USPC ..... 134/25.2, 56 D, 58 D
See application file for complete search history.

(56) References Cited

U.S. PATENT DOCUMENTS

2008/0210279 A1* 9/2008 Hildenbrand ..... 134/56 D
2010/0186776 A1* 7/2010 Bittner ..... 134/25.2

* cited by examiner

*Primary Examiner* — Michael Barr
*Assistant Examiner* — Caitlin N Dunlap
(74) *Attorney, Agent, or Firm* — Coats and Bennett PLLC

(57) ABSTRACT

A batch ware washing machine and/or related method of washing wares. The machine includes a moveable door which partially encloses a steam cavity. When the door is in the up or open position, hot moist air may be forcibly pulled from the steam cavity and into an exhaust plenum via an air inlet port that is strategically positioned above the top wall of the door when the door is in the closed position, but below the top wall when the door is in the open position. A controller causes the air to be forcibly pulled through the plenum for a predetermined exhaust time period, such as one minute, and then automatically stops the forced air exhaust movement. The exhaust plenum may be ducted directly to the outside of the surrounding building. The air conditioning load on the HVAC units serving the kitchen are reduced, thereby reducing energy consumption.

8 Claims, 4 Drawing Sheets

BATCH DISHWARE WASHING MACHINE WITH STEAM VENTING

BACKGROUND

The present invention is generally directed to food dishware washing devices, and more particularly to a device that washes wares with an improved steam exhaust technique, and related methods.

Restaurants and other food service establishments typically employ numerous devices to clean their plates, cups, glasses, utensils, and the like, collectively referred to in the art as "dishware" or simply "wares". One common example is a dishwashing machine. While dishwashing machines are also found in household settings, commercial dishwashing equipment differs in that they are typically faster and must meet numerous additional requirements, such as those dictated by health codes. Faster cleaning allows the food service establishment to have a lower inventory of wares, which takes up less physical space and lowers operating costs. However, health codes typically require that each piece of ware be rinsed by at least a certain minimum amount of water at or above a certain temperature (such as 180° F.), with the intent being that the surfaces of the ware will therefore necessarily reach at least a certain temperature in order to kill any bacteria that may be present thereon.

The use of hot water for rinsing tends to create hot moist air, sometimes referred to as steam, in the ware rinse area. Many typical ware washing machines allow this steam to enter the surrounding kitchen when the washing machine door is opened. Other ware washing machines employ a continuously-on exhaust fan to exhaust the steam into the surrounding kitchen. Further still, many ware washing machines are required to be placed under continuously running vent hoods so that the escaping steam may be vented outside the building. However, all of these approaches have proven less than satisfactory, primarily due to their excess energy consumption. As such, there remains a need for alternative approaches to ware washing machines and related methods, particularly approaches that result in better overall energy consumption.

SUMMARY

The present invention provides a batch ware washing machine and/or related method of washing wares. The batch ware washing machine includes a moveable door which partially encloses a steam cavity. When the door is in the up or open position, hot moist air may be forcibly pulled from the steam cavity and into an exhaust plenum via an air inlet port that is strategically positioned above the top wall of the door when the door is in the closed position, but below the top wall when the door is in the open position. A controller causes the air to be forcibly pulled through the plenum for a predetermined exhaust time period, such as one minute, and then automatically stops the forced air exhaust movement. The exhaust plenum may be ducted directly to the outside of the surrounding building. By limiting the time period that air is exhausted, and by exhausting the air to the outside rather than the kitchen area, the air conditioning load on the HVAC units serving the kitchen are reduced, thereby reducing energy consumption.

In one aspect, the present invention provides a batch ware washing machine that comprises a base unit and a moveable multi-sided door. The base unit has a plurality of output nozzles for delivering wash fluid and rinse fluid to a ware wash area. The moveable door defines a downwardly open steam cavity and is moveably mounted to the base unit for movement between a closed position to an open position. The door has a front wall, first and second lateral sidewalls disposed on opposing sides of the front wall, and a top wall. The door first and second lateral sidewalls may be disposed generally orthogonal to the front wall of the door. The steam cavity is upwardly bounded by the top wall and laterally bounded by the first and second sidewalls. The base unit has a rear wall rearwardly bounding the steam cavity and disposed opposite the front wall. A plenum is disposed in the rear wall. The rear wall comprises first and second air input ports leading to the plenum. The ware washing machine further comprises a controller operative to control drawing of air through the plenum. With the door in the closed position: 1) the door is lower than in the open position; 2) the door laterally and upwardly encloses the wash area; 3) first input port is disposed below the top wall and operatively interconnects the steam cavity to the plenum; and 4) the second input port is disposed above the door. With the door in the open position: 1) the door is higher than in the closed position; 2) the steam cavity is disposed above the wash area; 3) the wash area is open laterally; 4) the second input port is disposed below the top wall of the door and operatively connects the steam cavity with the plenum. The controller is configured to: a) cause air to be forcibly drawn in through at least the first input port and through the plenum for a predetermined time period; and b) thereafter, automatically cause the cessation of air being forcibly drawn through the plenum. The time period may be approximately one minute.

The controller may be configured to cause air to be forcibly drawn in through both the first and second input ports and through the plenum for the predetermined time period. The rear wall may have a plurality of forwardly extending lateral flanges disposed laterally outboard of the door in the open position. The batch ware washing machine may further comprise a duct opening to the plenum on one end and opening on the other end external to a building surrounding the base. The batch ware washing machine may further comprise a fan operative to draw air through the plenum and controlled by the controller. The fan may be disposed external or internal to the base unit. The door may be pivotally mounted to the base unit. There may be third, fourth, fifth, etc. inlet ports disposed a similar height above the second inlet port as the first inlet port (such as in a line or the like); each leading to the plenum.

In another aspect, the present invention provides a method of cleaning dishware, comprising washing and rinsing dishware in a wash area of a dishware machine while a multi-sided door in a closed position laterally and upwardly encloses the wash area. Thereafter, while the door remains in the closed position, forcibly drawing air into a generally vertically flowing plenum from a cavity defined by the door from via at least a first air inlet port disposed below a top wall of the door. Thereafter: a) moving the door upward to an open position above the closed position to laterally expose the wash area and move the cavity upward; and b) forcibly drawing air from the upwardly moved cavity into the plenum via at least a second air inlet port disposed below the top wall of the door when the door is in the open position, but above the top wall when the door is in the closed position. Thereafter, automatically ceasing the forcible drawing in of air to the plenum. The duration of the forcible drawing of air into the plenum is a first predetermined time period. The first predetermined time period may be approximately one minute.

The method may further comprise feeding output of the plenum directly to one end of a duct, the opposing end of the duct terminating outside a building that surrounds the dishware machine. The method may be such that, after the moving of the door to the open position, air is forcibly drawn into the plenum via the first and second inlet ports. The method may further comprise indicating the expiration of a second predetermined time period prior to the moving of the door to the open position; wherein the second time period begins with the initiation of forcibly drawing air into the plenum. The second time period may be approximately ten seconds. The forcibly drawing air into the plenum via at least a second air inlet port when the door is in the open position may comprise forcibly drawing air into the plenum via a fan disposed external to the dishware machine and operatively connected thereto by an intervening duct. The fan may be disposed external to a building housing the dishware machine. The forcibly drawing air into the plenum via at least a second air inlet port when the door is in the open position may comprise forcibly drawing air into the plenum via a fan disposed internal to the dishware machine and operatively connected to an exhaust duct that terminates outside a building that surrounds the dishware machine. The moving the door upward to the open position may comprise moving the door in a pivoting fashion.

The various optional features and aspects described above and below may be used alone or in any combination.

DETAILED DESCRIPTION

In one embodiment, the present application is directed to a batch ware washing machine and/or related method of washing wares. The batch ware washing machine includes a moveable door which partially encloses a steam cavity. When the door is in the up or open position, hot moist air may be forcibly pulled from the steam cavity and into an exhaust plenum via an air inlet port that is strategically positioned above the top wall of the door when the door is in the closed position, but below the top wall when the door is in the open position. A controller causes the air to be forcibly pulled through the plenum for a predetermined exhaust time period, such as one minute, and then automatically stops the forced air movement. The exhaust plenum may be ducted directly to the outside of the surrounding building. By limiting the time period that air is exhausted, and by exhausting the air to the outside rather than the kitchen area, the air conditioning load on the HVAC units serving the kitchen are reduced, thereby reducing energy consumption.

Figure 1:
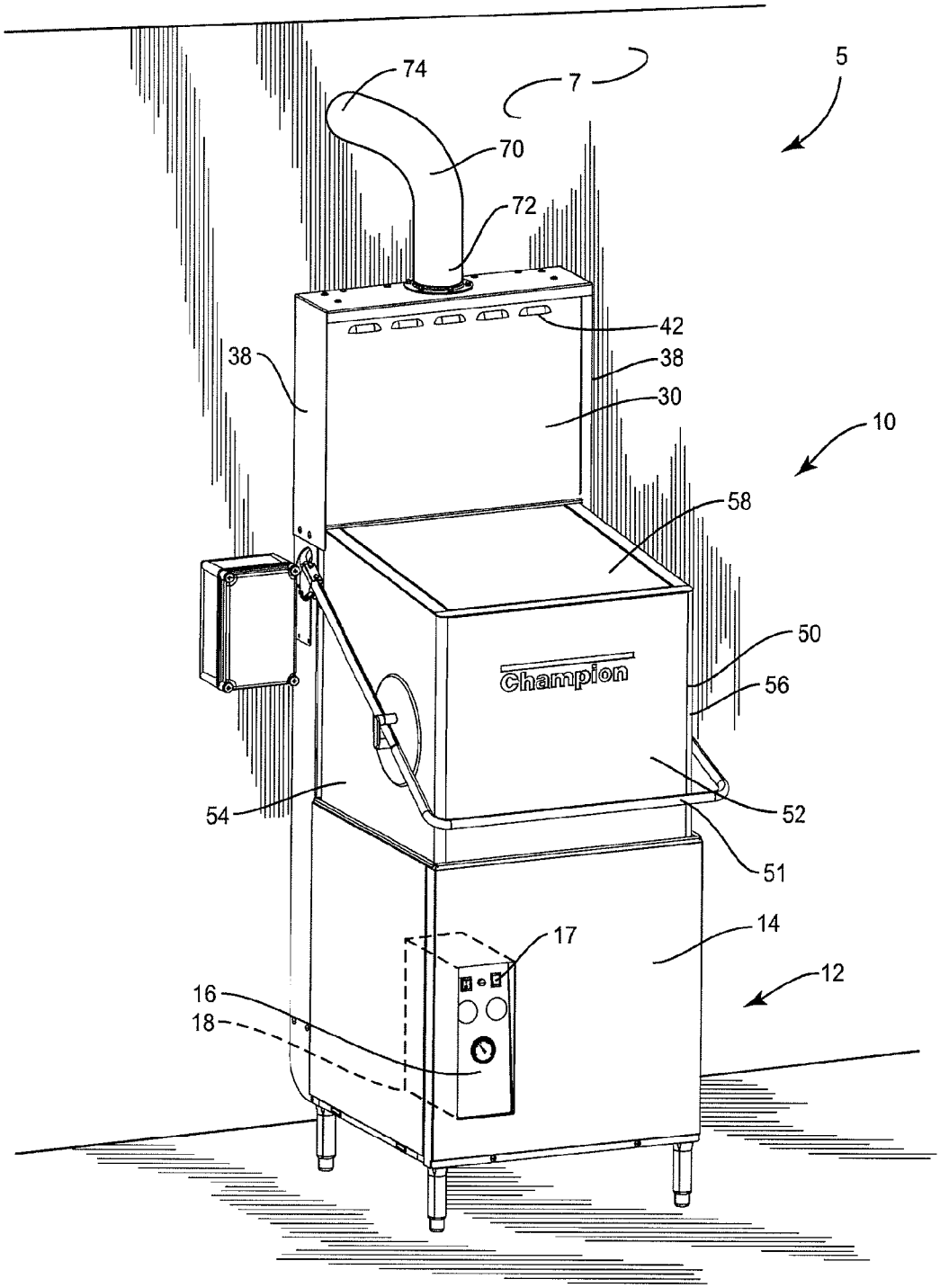
FIG. 1 shows a ware washing machine according to one embodiment disposed in a kitchen area of a building.

FIG. 1 shows a kitchen area of building 5, such as a restaurant, nursing home, or the like. A batch ware washing machine, generally indicated at 10, is located in the kitchen, advantageously in proximity to an outer wall 7. An exhaust duct 70 connects the washing machine 10 to the outer wall 7, and provides a route for exhausting hot moist air from the washing machine 10 to outside the building 5. As such, an inlet end 72 of the exhaust duct 70 attaches to the washing machine 10, and an outlet end 74 of the exhaust duct 70 terminates at or beyond the outer wall 7 so as to direct the exhaust outside the building 5. A fan 80 is operatively connected to the exhaust duct 70 to force air/steam to move through the exhaust duct 70. The fan 80 may be disposed on the outer wall 7 or elsewhere as described below. The fan 80 operates under the control of controller 18 of the ware washing machine 10, as discussed further below.

Figure 2:
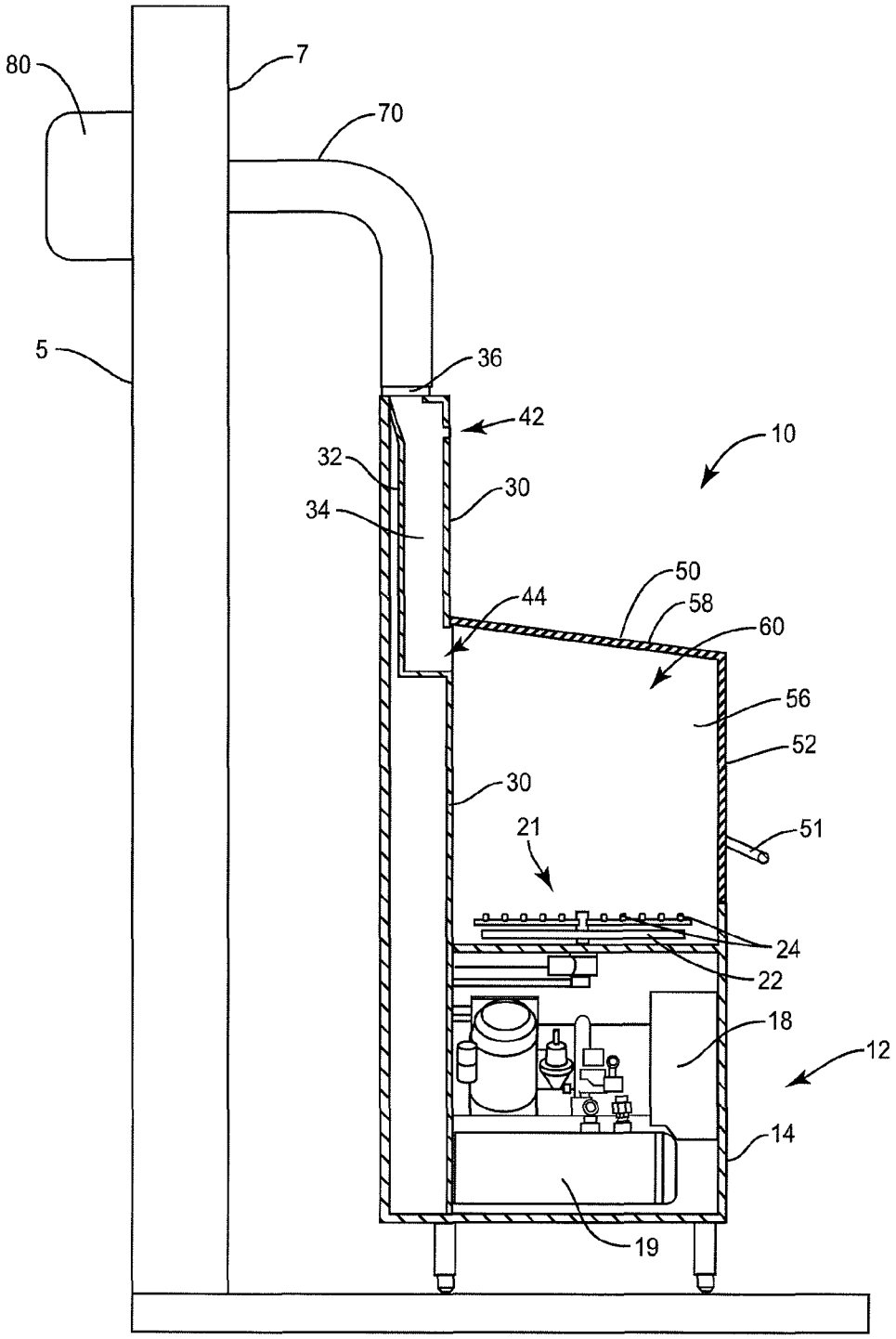
FIG. 2 shows a side partial cross-sectional view of the ware washing machine of FIG. 1 with the door in the closed position.

As shown in FIG. 2, the washing machine 10 includes a base unit 12 and a door 50 moveably supported by the base unit 12. The base unit 12 includes a cabinet 14 for housing controller 18, one or more water heaters 19, wash/rinse equipment 22, and other components of the washing machine 10 known in the art. An operator interface panel 16 is located on the front of the base unit 12, and includes suitable gages, switches, and indicator lights 17 as known in the art. The wash/rinse equipment 22, advantageously including nozzles 24 on rotatable arms, is disposed in a well 21 in the base unit 12, as shown in FIG. 2. The wash/rinse equipment 22 supplies wash fluid and rinse fluid to the ware wash area 20 formed by base unit 12 and door 50 to clean the wares therein. The well 21 forms the lower extent of the ware wash area 20, and the door 50 (in the closed position) forms the upper, front, and lateral sides of ware rinse area 20. A rear wall 30 of the base unit 12 provides the rear wall of the ware rinse area 20. The rear wall 30 of base unit 12 extends upward above the well 21 and provides a location for moveably mounting the door 50.

As indicated above, the door 50 is moveably mounted to the base unit 12. For the embodiment of FIG. 2, the door 50 is indirectly mounted to the base unit 12 via pivoting handle 51. A counter-weight mechanism may be associated with handle 51 to facilitate easy opening of the door 50. Door 50 includes a top wall 58, a front wall 52, and a left lateral side wall 54 and a right lateral side wall 56. The walls 52,54,56,58 are advantageously disposed so as to form a generally rectangular enclosure, with an open bottom and an open rear. The rear wall 30 of the base unit 12 is disposed behind the door 50, and acts as a rear wall for the cavity 60 formed by the door 50. Because this cavity 60 typically encloses hot moist air ("steam") during the washing process, this cavity bounded by the walls of door 50 may be referred to as the steam cavity 60. The door 50 is movable between a closed position, where the door 50 laterally and frontwardly encloses the ware wash area 20, and a raised or open position where the door 50 is disposed higher than in the closed position and does not laterally enclose the ware wash area 20, so that wares may be loaded and unloaded from the ware wash area 20. As can be appreciated, when the door 50 is in the closed position, the steam cavity 60 and the ware rinse area 20 overlap so that the steam cavity 60 is coincident with part of the ware wash area 20, above the well 21. Note that to contain the fluids sprayed during the wash cycle, the interface between the lower edge of the door 50 and the base unit 12 should be sufficiently sealed to prevent the liquid from escaping, but advantageously open enough to allow the drawing in of air, as explained further below.

The wash/rinse equipment 22 supplies wash fluid and rinse fluid to the ware wash area 20 during the wash cycle. During the rinse portion of the wash cycle, hot water is sprayed in the ware wash area 20 via nozzles 24. Typically, the hot water is sprayed for a sufficient time so that the wares reach a mandated temperature, such as 180°. The hot water causes steam to be generated, which the washing machine 10 exhausts using a novel approach that utilizes a pair of inlet ports 42,44 disposed on rear wall 30 and control of the exhaust air flow, as discussed further below. Although any suitable configuration of wash/rinse equipment 22 known in the art may be used, the wash/rinse equipment 22 may advantageously take a configuration similar to that shown in U.S. Patent Application Publication No. 2010/0051063.

A pair of air inlet ports 42,44 are disposed on rear wall 30, with inlet port 42 disposed higher than inlet port 44. The inlet ports 42,44 lead to plenum 34 which is disposed inside rear wall 30. The plenum 34 extends downward to at least inlet port 44, and upward to the top of rear wall 30. The plenum 34 may be approximately the same cross-sectional size as the interior of the rear wall 30, or may advantageously be smaller, such as partially defined by a partition 32 internal to rear wall 30. The plenum 34 is operatively connected to exhaust duct 70 at plenum outlet 36 so that air leaving plenum 34 is exhausted outside of the building 5. The lower inlet port 44 is vertically positioned below the level of the top wall 58 of door 50 when door 50 is in the closed position so that the lower inlet port 44 provides an airflow path between the steam cavity 60 and the plenum 34 when the door 50 is closed. Advantageously, the vertical position of the lower inlet port 44 also allows the lower inlet port 44 to open to the steam cavity 60 when the door 50 is in the open position, although this is not required in all embodiments. The upper inlet port 42 is disposed higher than the lower inlet port 44 so that the upper inlet port 42 is vertically positioned above the door 50 when the door 50 is closed, but below the door top wall 58 when the door 50 is in the open position. Thus, the upper inlet port 42 provides an airflow path between the steam cavity 60 and the plenum 34 when the door 50 is open.

To wash the wares, the door 50 is moved to the open (raised) position (step 210), and the wares, typically loaded on a ware tray, are loaded into the ware wash area 20 (step 220). The door 50 is then closed, and the wash cycle is initiated, either automatically or via user input at the operator interface panel 16 (step 230). The wash/rinse equipment 22, optionally including the nozzles 24, are then used to spray wash fluid (e.g., water and detergent) in the ware wash area 20. When the wash portion of the wash cycle is complete, the wash/rinse equipment 20, including nozzles 24, then spray rinse fluid (e.g., hot water) in the ware wash area 20. Either during the spraying of the rinse fluid, or at the conclusion thereof, the controller 18 causes the fan 80 to turn on so as to forcibly draw air from the steam cavity 60. The fan 80 forces air out of the plenum 34, with that air being replaced by air input to the plenum 34 from the steam cavity 60 via the lower air inlet port 44, with that air in turn replaced by ambient air from the kitchen (entering the wash area 20 via the interface between the lower edge of the door 50 and the base unit 12). During this initial draw-out of air, the indicator 17 should indicate to the user that the wash cycle is not yet complete. This initial draw-out of air lasts a predetermined time period T2 (step 240), after which the "done" indicator 17 may change status to indicate to the user that the door 50 can be raised (step 250). The length of time period T2 may be adjusted as desired, but a period of approximately ten seconds is believed appropriate for most situations. The door 50 is then raised to the open position (step 260), so that the steam cavity 60 is raised upward and the door 50 does not laterally bound the ware wash area 20. The user may then remove the wares, if desired. It should be noted that the fan 80 continues to run at this point, forcing airflow through the plenum 34. However, with the door 50 in the open (raised) position, the steam cavity 60 is now able to supply air to the plenum 34 via the upper inlet port 42. Thus, air is drawn from the steam cavity 60 via the upper inlet port 42 (and optionally also the lower inlet port 44), into the plenum 34, to the duct 70, and exhausted outside the building 5. After a predetermined time period T1 (step 270), the fan 80 is stopped (step 280). The length of time period T1 may be adjusted as desired, but a period of approximately one minute (e.g., about forty-five seconds to about seventy-five seconds, more preferably about sixty seconds) to is believed appropriate for most situations. This duration allows for the hot air to be exhausted from the steam cavity 60, while minimizing the amount of excess ambient air from the kitchen that is exhausted. Thus, there is less "make up" air that the kitchen HVAC system needs to condition, as less air has been removed from the kitchen.

In some embodiments, the base unit 12 may include forwardly extending side flanges 38 attached to the rear wall 30. These flanges 38 advantageously laterally overlap the rear portion of door 50, and act to help contain the steam in steam cavity 60.

In some embodiments, the fan 80 may be located on outer wall 7 of building 5, with suitable electrical connections to controller 18 so that controller 18 may control the operation of fan 80. In other embodiments, a fan 80 may be additionally or alternatively internal to ware washing machine 10. For example, fan 80 may be disposed at the exhaust end of plenum 34, internal or external to rear wall 30.

In some embodiments, an automatic interlock (not shown) may be used to ensure that door 50 stays closed during time period T2. For example, controller 18 may control interlock so that the door 50 is locked in the closed position until the expiration of time period T2, and thereafter release the interlock so that door 50 may be raised by the operator.

Note that the discussion above has assumed that time periods T1, T2 start with the initiation of the wash cycle. An equivalent approach is to start time periods T1, T2 from the start of the wash cycle, with suitable adjustments to their duration.

Note further that, in some embodiments, there may be an additional open exhaust hood above the ware washing machine 10, but such is not required, and the ware washing machine 10 may be located away from an open exhaust hood because the steam is vented out of the building even when the door 50 is open.

Figure 3:
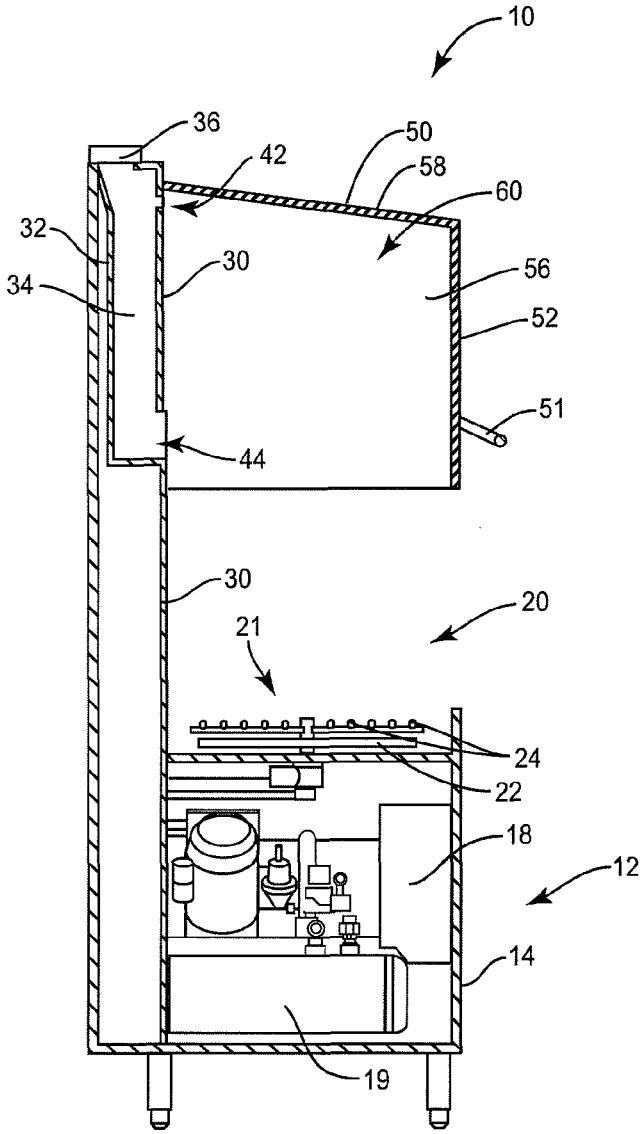
FIG. 3 shows a view similar to FIG. 2, with the door in the open position and some items removed for better clarity.
Figure 4:
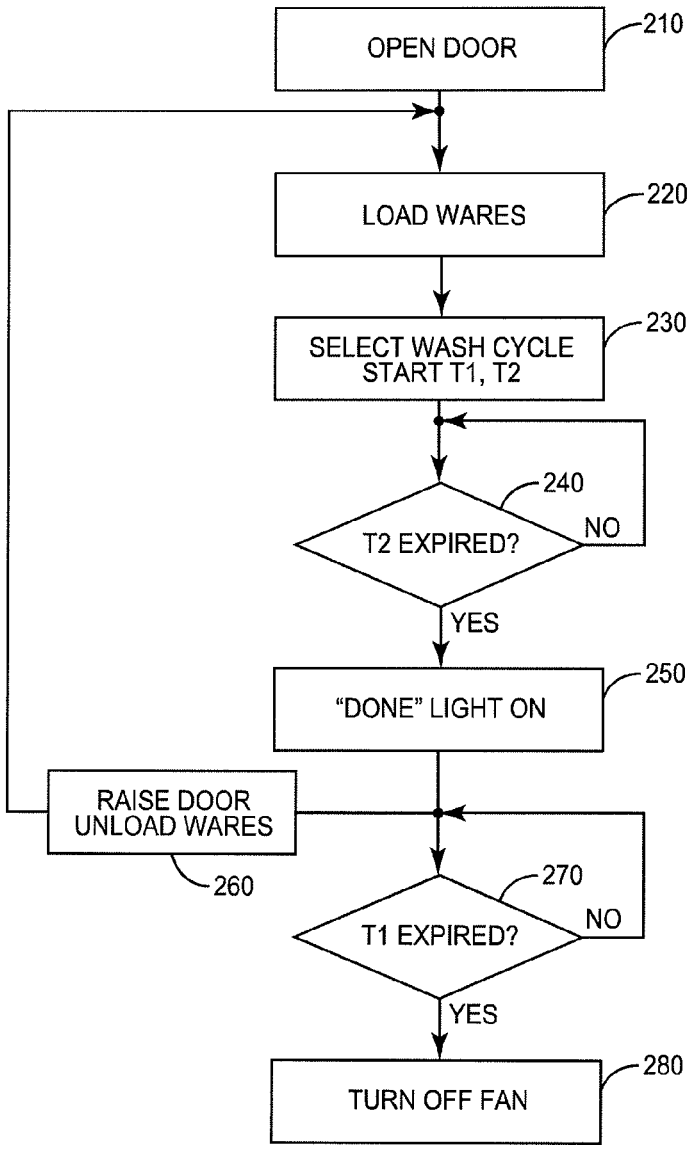
FIG. 4 shows a simplified flow diagram of one ware washing process.

The ware washing machine 10 allows for a shortened cycle time because in the door up position (FIG. 3), the door 50 with the rear wall 30 allows the cavity 60 to act as an exhaust hood above the wares that continue to exhaust steam and heat produced in the washing/rinse cycles as well as the steam and heat coming off the wares in the door open opposition.

All U.S. patents, patent application publications, and applications mentioned above are hereby incorporated herein by reference in their entirety.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A method of cleaning dishware, comprising:

washing and rinsing dishware in a wash area of a dishware machine while a multi-sided door, in a closed position, laterally and upwardly encloses the wash area;

thereafter, while the door remains in the closed position, forcibly drawing air into a generally vertically flowing plenum from a cavity defined by the door via at least a first air inlet port disposed below a top wall of the door;

thereafter:

moving the door upward to an open position, which is above the closed position, to laterally expose the wash area and move the cavity upward;

forcibly drawing air from the upwardly moved cavity into the plenum via at least a second air inlet port disposed below the top wall of the door when the door is in the open position, but above the top wall when the door is in the closed position;

thereafter, automatically ceasing the forcible drawing in of air to the plenum;

wherein a duration from a start of the forcible drawing of air from the cavity while the door remains in the closed position, to an end of the forcible drawing of air from the upwardly moved cavity is a first predetermined time period.

2. The method of claim 1 wherein the first predetermined time period is approximately one minute.

3. The method of claim 1 further comprising feeding output of the plenum directly to one end of a duct, the opposing end of the duct terminating outside a building that surrounds the dishware machine.

4. The method of claim 1 wherein, after the moving of the door to the open position, air is forcibly drawn into the plenum via the first and second inlet ports.

5. The method of claim 1 further comprising indicating the expiration of a second predetermined time period prior to the moving of the door to the open position; wherein the second time period begins with the start of the forcible drawing of air from the cavity while the door remains in the closed position.

6. The method of claim 5 wherein the second time period is approximately ten seconds.

7. The method of claim 1 wherein the forcibly drawing air into the plenum via at least a second air inlet port when the door is in the open position comprises forcibly drawing air into the plenum via a fan disposed external to the dishware machine and operatively connected thereto by an intervening duct.

8. The method of claim 7 wherein the fan is disposed external to a building housing the dishware machine.

* * * * *

UNITED STATES PATENT AND TRADEMARK OFFICE

CERTIFICATE OF CORRECTION

PATENT NO. : 8,623,150 B2
APPLICATION NO. : 13/332692
DATED : January 7, 2014
INVENTOR(S) : Vroom et al.

It is certified that error appears in the above-identified patent and that said Letters Patent is hereby corrected as shown below:

Title Page, Item (75) Inventor is corrected to read:
--Robert C. Vroom, Kernersville, NC (US);
Patrick S. Conklin, Kernersville, NC (US);
Luke L. DiVenti, Greensboro, NC (US);--

Signed and Sealed this
Fourteenth Day of April, 2015

Michelle K. Lee

Michelle K. Lee
*Director of the United States Patent and Trademark Office*